US005409051A

United States Patent [19]

Mullet et al.

[11] Patent Number: 5,409,051

[45] Date of Patent: Apr. 25, 1995

[54] TRACK SYSTEM FOR SECTIONAL DOORS

[75] Inventors: Willis Mullet, Pensacola Beach; Albert W. Mitchell, Pace, both of Fla.

[73] Assignee: Wayne-Dalton Corp., Mt. Hope, Ohio

[21] Appl. No.: 58,514

[22] Filed: May 3, 1993

[51] Int. Cl.[6] ..... E05D 15/06

[52] U.S. Cl. ..... 160/201; 160/209

[58] Field of Search ..... 160/201, 209; 16/96 R

[56] References Cited

U.S. PATENT DOCUMENTS

| | | | |
|---|---|---|---|
| 953,244 | 3/1910 | Van Camp | 160/209 X |
| 1,461,839 | 7/1923 | Tenneson | 160/209 |
| 1,990,870 | 2/1935 | Kelly | 160/209 X |
| 2,012,336 | 8/1935 | Blodgett | 160/209 X |
| 2,029,201 | 1/1936 | Shaffer | 160/209 X |
| 2,066,558 | 1/1937 | Dautrick | 160/209 |
| 2,236,912 | 4/1941 | Lukaszewski . | |
| 2,441,092 | 5/1948 | Weathers | 74/25 |

FOREIGN PATENT DOCUMENTS

| | | | |
|---|---|---|---|
| 12400 | of 1908 | United Kingdom | 160/201 |
| 354894 | 8/1931 | United Kingdom . | |

*Primary Examiner*—Blair M. Johnson

*Attorney, Agent, or Firm*—Renner, Kenner, Greive, Bobak, Taylor & Weber

[57] ABSTRACT

A track system (110) for a door (120) having a plurality of panels including a top panel (121) and a hinge connected adjacent panel (122), having an inner side for attaching mounting hardware and being movable between a closed vertical position proximate a door frame and an open horizontal position including, substantially vertical track (111) adapted to be displaced from the door frame (F) a distance sufficient for receiving a plurality of rollers (142, 152, 162, 165) attached to and spaced from the inner side of the door, transition track (112) commencing at the upper extremity of the vertical track and curving through an angle of substantially ninety degrees for receiving a top roller (132) positioned proximate the upper extremity of the top panel and spaced from the inner side thereof a distance greater than any of the plurality of spaced rollers, and horizontal track (114) extending from the transition track and having a curvilinear configuration for maintaining the top panel and the adjacent panel of the door pivoted about the hinge to remain downwardly concave during traverse of the rollers therein.

11 Claims, 2 Drawing Sheets

TRACK SYSTEM FOR SECTIONAL DOORS

TECHNICAL FIELD

The present invention relates generally to a track system for sectional doors. More particularly the present invention relates to a track system for sectional doors which move between a closed position proximate to a vertical door opening to an open position in a substantially horizontal orientation. More specifically, the present invention relates to a track system for use in conjunction with multi-section doors which are moveable from a horizontal position to a vertical position, wherein the positioning of the rollers as attached to such a door for proper positioning in its vertical closed position is accommodated by the configuration of the track supporting the door in the horizontal position, substantially without imparting deleterious forces to the door and its mounting hardware.

BACKGROUND ART

Track systems have been commonly employed for sectional doors for many years to control the movement of the individual sections of the doors. Common examples of such sectional doors are the type employed as garage doors in homes, commercial and utility buildings, and similar applications. These track systems are commonly of a generally L-shaped configuration, which includes a vertical section positioned proximate a door frame and a horizontal section that extends substantially perpendicular to the vertical section rearwardly into the interior of the building in an overhead position. A curved transition section is normally positioned proximate the header at the top of a door frame and interconnects with the vertical section and the horizontal section to provide a continuous track system. The panels constituting conventional sectional doors are joined by hinges on the inner or internal side of the door, which form pivot points at the juncture between each of the panels to permit the panels to pivot inwardly toward each other as the door progressively moves through the curved transition section between the vertical closed position and the horizontal open or storage position. The hinge brackets normally have projecting flanges which mount rollers that are captured in the track sections, which are normally of a "J" or "C" cross-sectional configuration.

In a great many environments, there are severe limitations in the overhead clearance available above a door frame, which may take the form of the garage ceiling or support beams, piping, or other elements which extend downwardly from the ceiling. In order to minimize the overhead clearance required for the horizontal track section and the operation of the door panels in relation thereto, it is common to place the curved transition section of the track as low as possible and preferably in the area of rather than above the header of a door frame. As a result, the mounting bracket for the roller positioned proximate to the upper edge of the top panel of the door to control its movement must be offset a substantial distance from the door to repose in the curved transition section in order to provide for full closure of the upper panel of the door. This, however, results in the roller at the top of the top panel being offset from the door a substantially greater distance than the other rollers.

While this arrangement has been widely employed in the industry for many years, it produces a problem when the sectional door is moved to the open position as the rollers move into the horizontal track section. In particular, with the door supported on the rollers in the horizontal track section, the greater offset of the top roller than that of the roller at the juncture between the top panel and the upper middle panel and the roller at the juncture between the upper middle panel and the lower middle panel, urges the top and upper middle panels to pivot at their juncture in a backward or reverse direction to the hinge connection. This condition, which is commonly aptly termed "backbreak" in the industry, is a source of wear that can lead to premature failure of components. In this respect, there is a tendency for the edges of the top panel and the upper middle panel to be crushed by the backward compressive force which is contra to and cannot be accommodated by the hinges. Further, the edges of the top panel and the upper middle panel in the area underlying the hinge tends to separate, which can produce damage to the hinge, the hinge pin, the fasteners attaching the hinges to the door panels, and/or the integrity of the door panels themselves. Additionally, the rollers between the top panel and the adjacent or upper middle panel can be forced upwardly, despite the weight of the door, so severely as to distort, even permanently, the horizontal track section and the rollers. In extreme cases, the rollers may distort the track section to an extent that a roller escapes from the track, causing a system breakdown. At the least, this condition causes erratic resistance to door movement and attendant increased noise levels.

The industry has tried numerous approaches to endeavor to eliminate or at least reduce the severity of this backbreak condition. In some instances, the extent of offset of the top roller of the top panel is reduced; however, in this circumstance, there is normally a difficulty in seating the top panel against the door frame, such that the panel may rattle or vibrate and is not sealed in weather-tight relation to the door frame or weather stripping which may be installed thereabout.

Another approach which has been taken in some instances is to lower the position of the top roller on the top panel, such that a lesser offset distance is required. While this may somewhat reduce the backbreak condition, it creates a high arc condition in that the top of the top panel moves a greatly increased distance above the horizontal track section as it passes through the transition section. Thus, substantial additional headroom is required to clear the travel of the top of the top panel, which, as previously indicated, is a severe limitation that must be avoided for all-purpose door installations which seek to meet stringent overhead clearance limitations.

Approaches which have been directed to a departure from the basic door and track configuration have suggested the use of a separate track for the top roller; however, this entails a much more complex and expensive track arrangement and loss of headroom. Other approaches have included the construction of track sections of heavier gauge material to prevent deflection and possible distortion due to the movements of the rollers; however, this solution merely concentrates the resultant forces on the rollers, hinge brackets, and the door panels themselves.

Due to the lack of a viable solution, the industry has essentially predicated designs on a compromise of the these various competing considerations. However, there has remained an extent of the backbreak problem, top panel sealing problems, and/or overhead clearance limitations with existing doors of conventional track and roller design.

DISCLOSURE OF THE INVENTION

Therefore, an object of the present invention is to provide a track system for sectional doors which employs essentially the standard configuration for sectional doors and rollers, while eliminating backbreak conditions and the deleterious effect upon the track system, doors, and rollers and mounting brackets therefor. Another object of the invention is to provide such a track system which does not solve the backbreak condition problem at the expense of other considerations, such as the maintenance of a top panel seating against the door frame and placement of the top roll on the top panel of a door, such as to maintain an operational capability for installation in relatively low overhead environments. A further object of the present invention is to provide such a track system which uses conventional components, except for the horizontal track section, while providing other incidental benefits.

Another object of the present invention is to provide a track system for a sectional door wherein the horizontal track section is curvilinear over substantially its entire length, whereby the top panel of the door and the adjacent panel remain slightly pivoted in a downwardly concave configuration during traverse of the supporting rollers in the horizontal track, such as to eliminate backbreak. Yet another object of the present invention is to provide such a track system wherein the high point of the curvilinear horizontal track section is located substantially medially of the horizontal track section. Yet a further object of the present invention is to provide such a track system wherein the door is substantially balanced in the open position without tendencies to close or overrun the open position, as may result from angling a straight or linear horizontal track section upwardly or downwardly with respect to its point of connection with the transition track section.

Another object of the present invention is to provide a track system for a sectional door that may employ conventional J-shaped track sections without the application of forces thereto, which may produce deformation of the track sections or mounting elements therefor and which can even result in escape of the door rollers from the confines of the track sections. Still a further object of the present invention is to provide such a track system which allows the use of lighter gauge materials for the track sections, which are easier to handle during transport and installation and are less expensive, because backbreak conditions are avoided and the attendant forces normally applied to the horizontal track section are not introduced. Still another object of the present invention is to provide a track system for sectional doors employing a horizontal track section which is capable of retrofit installation in existing door systems.

Still another object of the invention is to provide a track system for a sectional door which has application with respect to a wide range of door and track designs that are currently extant in the market. Still a further object of the present invention is to provide such a track system which requires a minimum of maintenance in that adjustments are not required, and the loading thereon created by the door does not tend to produce distortion or damage, which can affect the operation of a sectional door or an operator therefor over extended time periods.

In general, the present invention contemplates a track system for a door having a plurality of panels including a top panel and a hinge connected adjacent panel, having an inner side for attaching mounting hardware and being movable between a closed vertical position proximate a door frame and an open horizontal position including, substantially vertical track adapted to be displaced from the door frame a distance sufficient for receiving a plurality of rollers attached to and spaced from the inner side of the door, transition track commencing at the upper extremity of the vertical track and curving through an angle of substantially ninety degrees for receiving a top roller positioned proximate the upper extremity of the top panel and spaced from the inner side thereof a distance greater than any of the plurality of spaced rollers, and horizontal track extending from the transition track and having a curvilinear configuration for maintaining the top panel and the adjacent panel of the door pivoted about the hinge to remain downwardly concave during traverse of the rollers therein.

PREFERRED EMBODIMENT FOR CARRYING OUT THE INVENTION

Figure 1:
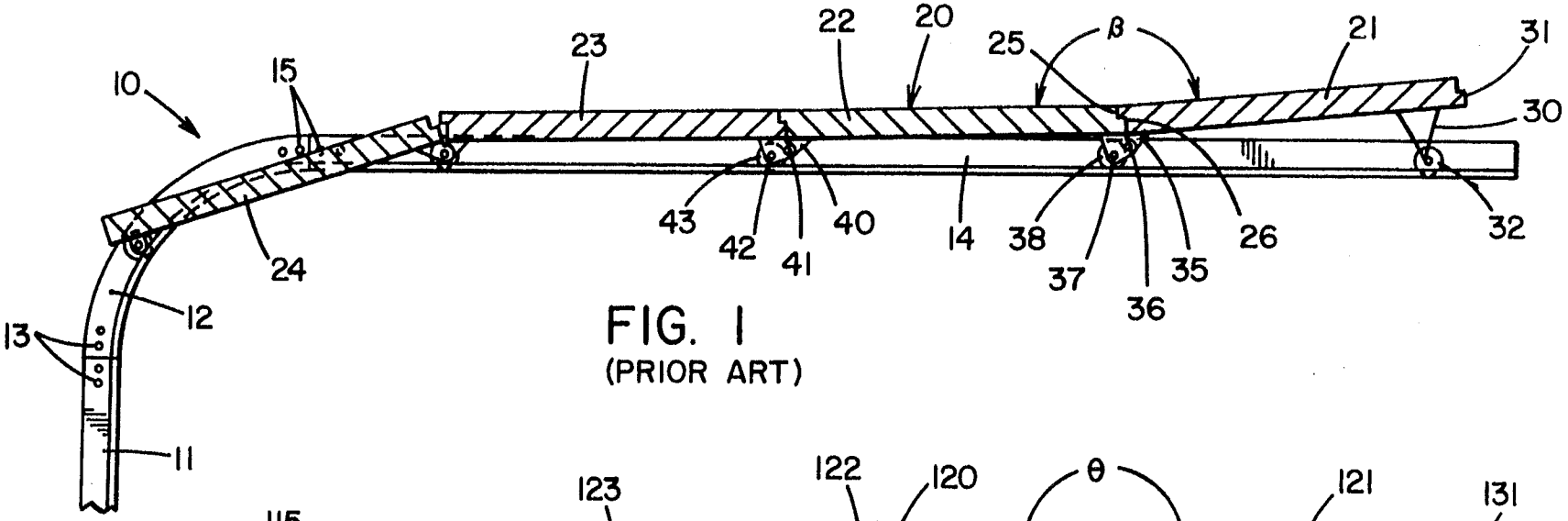
FIG. 1 (PRIOR ART)
FIG. 1 is a side-elevational view of a conventional prior art horizontal track portion of a track system for a sectional door, with the door shown in section in the fully open position.

Track systems for sectional doors of the type commonly employed for garages and similar applications have been known in the art for many years. A fragmentary depiction of a typical prior art track system is generally indicated by the numeral 10 in FIG. 1 of the drawings. Such a track system 10 has a vertical track section 11 of appropriate length to extend substantially from the ground or floor of a garage or other structure to a position proximate the header of a door frame. The vertical track section 11 is connected to a curved transition track section 12 as by bolts 13 or rivets or other fasteners which are positioned in the track sections 11, 12 and are commonly joined by connector plates (not shown). A horizontal track section 14 is attached to the curved transition track section 12 as by bolts 15 or other fasteners in the manner described hereinabove with respect to the fasteners 13.

It is standard in the art to fashion the vertical and horizontal track sections 11, 14 of straight pieces of rails, which are subsequently cut to length for a particular installation, depending upon the height of a door to be installed, the brackets or other elements to be employed to support the track sections 11, 12, 14 and the door itself. It is, of course, well understood that a configuration of track sections 11, 12, 14 is positioned proximate to the jamb at either side of a door frame, with one rail being shown in FIG. 1. The rails are normally symmetrically opposite but otherwise structurally identical.

A conventional sectional door is generally indicated by the numeral 20 in FIG. 1. For exemplary purposes, a four-panel sectional door is shown in FIG. 1 of the drawings; however, it will be appreciated by persons skilled in the art that five, six, or more panels may be employed in such sectional doors, depending upon the height of the door opening and related considerations. Also, the door may have a lateral width and related reinforcing, again depending upon the width of the door opening, the materials used in fabricating the panels, and similar factors.

As shown, the sectional door 20 consists of a top panel 21 and an adjacent or upper middle panel 22, a lower middle panel 23, and a bottom panel 24. The top panel 21 may have a bottom edge 25 which matingly interfits with a top edge 26 of the adjacent panel 22. In conventional fashion, the top panel carries a top bracket 30 near the top edge 31 thereof, which mounts a roller 32 that is offset from the door a substantial distance to effect closure of the top panel when the door is in the vertical closed position, as hereinabove discussed. A hinge bracket 35 is attached to the panels 21, 22 at their juncture and includes a conventional pivot pin 36. Preferably slightly below the pivot pin 36 there is a shaft 37 that mounts a roller 38, which may be substantially identical to the roller 32. Similarly, at the juncture between panels 22 and 23, there is a hinge bracket 40 comparable to bracket 35 having a pivot pin 41 and also carrying a shaft 42 mounting a roller 43.

As can be readily seen in FIG. 1, the disparity in the distance that rollers 43 and 38 are displaced from the door by their respective brackets 40 and 35, as contrasted with the distance roller 32 is offset by the bracket 30 produces a "backbreak" condition. This is characterized by the panels 21 and 22 being deflected in a reverse bending, as contrasted with the bending or pivoting normally provided by the pivot pin 36, such that the panels 21, 22 assume a downwardly convex configuration, as can be clearly seen in FIG. 1. In this respect, the panels 21 and 22 on the top or front of the door assume an angle $\beta$ of less than 180 degrees. It is also to be noted that while the rollers 32 and 43 remain seated in the bottom of the horizontal track 14 due to panel weight, the roller 38 is raised off of the bottom of the track and engages the top of the track, such that the weight of panels 21 and 22 is downwardly unsupported at the juncture therebetween. This backbreak condition will, as will be appreciated from FIG. 1, place strong compressive forces on the edges 25, 26 of panels 21 and 22, respectively, in the area proximate the top or front surface thereof, which can damage or distort the panels. Concomitantly, the portion of the edges 25 and 26 of panels 21 and 22, respectively, proximate the lower or inner surface tend to separate, thereby placing severe forces on the hinge bracket 35, pivot pin 36, fasteners (not shown) attaching the hinge bracket 35 to the door sections 21, 22, and the door panels 21, 22 themselves where the brackets 35 are affixed. The wear and/or damage which necessarily results from this backbreak condition is detailed hereinabove in the background discussion.

Figure 3:
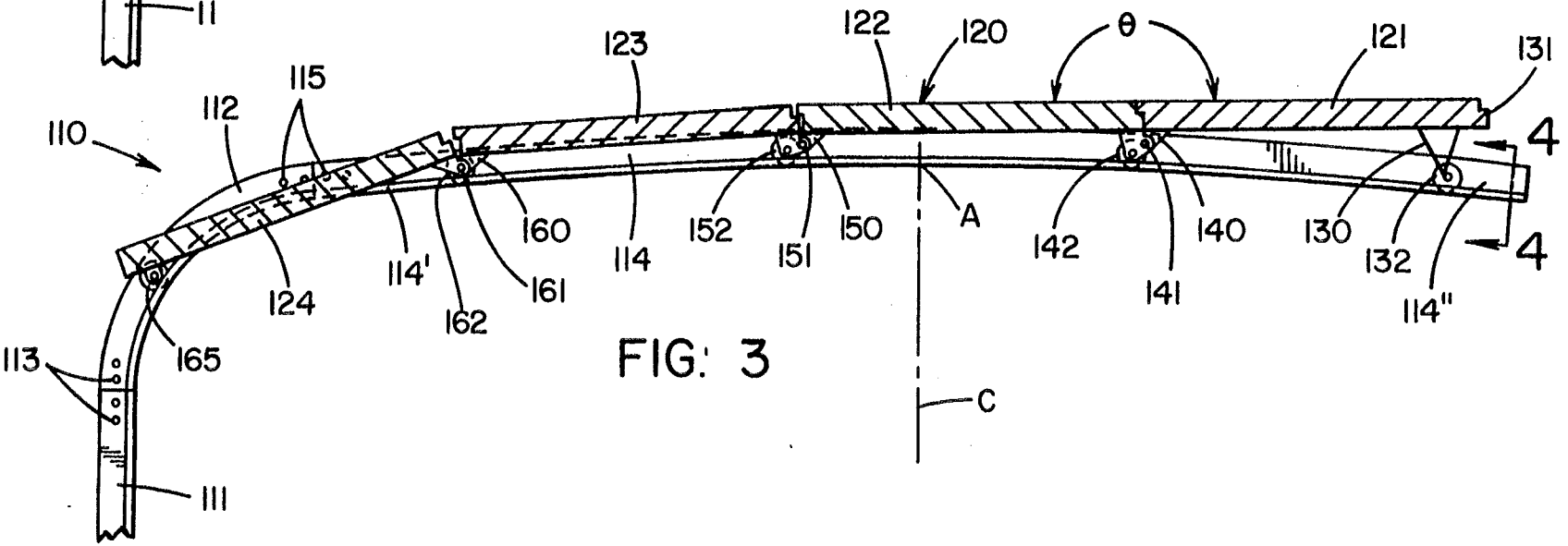
FIG. 3 is an enlarged fragmentary, elevational view similar to FIG. 1 showing the horizontal portion of the track system of FIG. 2 with a door shown in section reposing in the open position.
Figure 2:
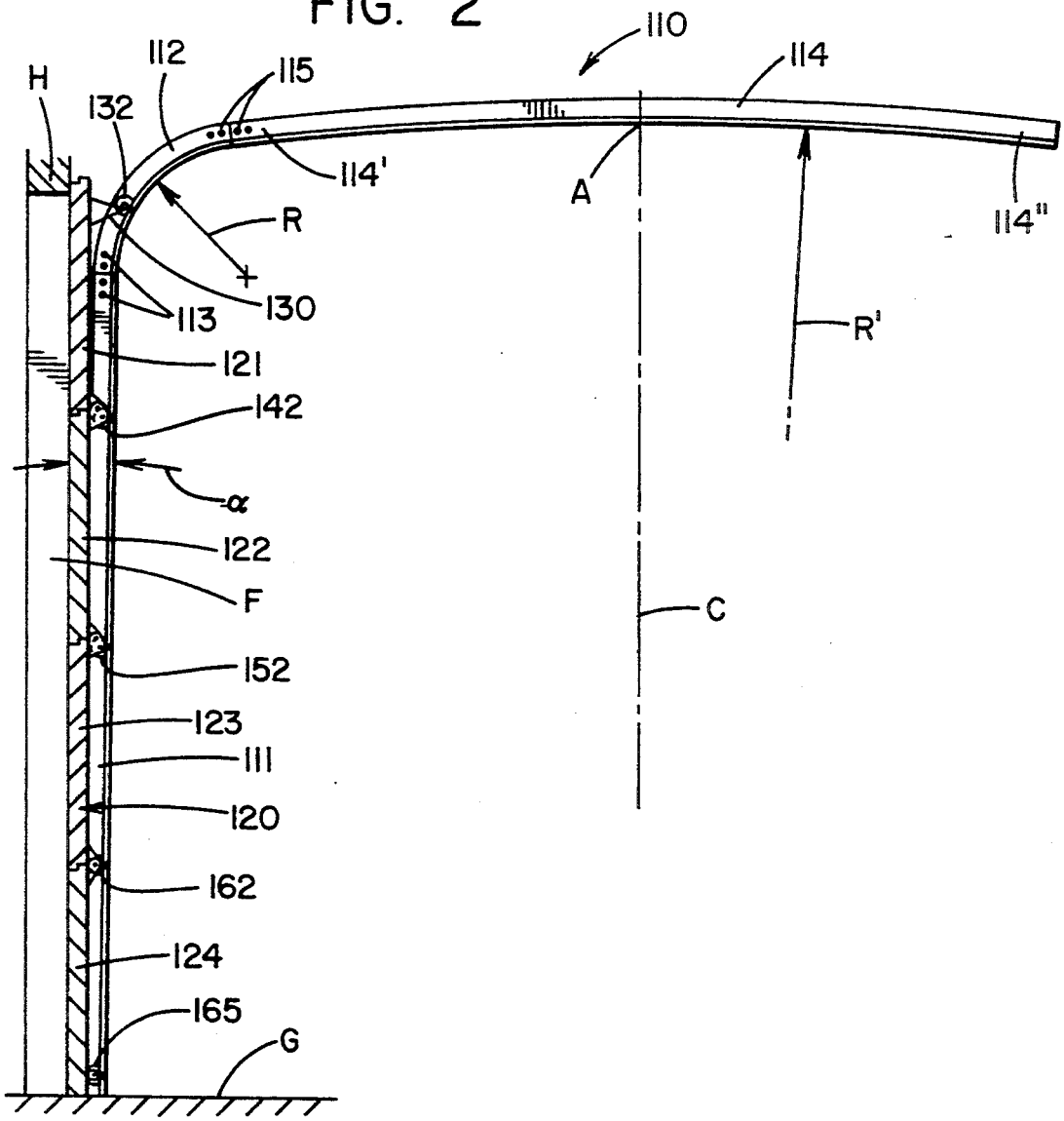
FIG. 2 is a side-elevational view of a track system for sectional doors according to the concepts of the present invention, with the door shown in section in the vertical closed position in proximity to the header and jamb of a door frame.

The track system according to the present invention is generally indicated by the numeral 110 in FIGS. 2 and 3 of the drawings. As shown, the track system 110 has a vertical track section 111 of an appropriate length to extend from the ground G or floor of a garage or other structure to a position proximate the header H of a door frame F. The vertical track section 111 is connected to a curved transition track section 112 as by bolts 113 or rivets or other fasteners which are positioned in track sections 111, 112 and are commonly joined by connector plates (not shown).

A horizontal track section 114 is attached to the curved transition track section 112 as by bolts 115 or other fasteners in the manner described hereinabove with respect to the fasteners 113. It will be appreciated that track sections 112 and 114 could be formed as a single, integral unit, if desired, providing the configurations described hereinbelow are achieved.

For most garage applications, the curved transition track section 112 is designed to have a radius R of approximately 12 inches (FIG. 2). The horizontal track section 114 of the present invention is curvilinear from a first end 114' proximate curved transition track section 112 to a second remote end 114", where the track section 114 terminates. While the rate of change of curvature over the length of horizontal track section 114 might be varied for particular applications, it is preferred for many installations that the horizontal track section 114 be an arc of a circle having a radius of 400 to 600 inches. The center of the circle is preferably positioned on a centerline C located substantially medially of horizontal track section 114. This provides for an apex A in the horizontal track 114 at its intersection with centerline C, which has a rise in the range of approximately one to three inches above each of the ends 114', 114" of the horizontal track 114. For conventional seven-foot doors, a preferred rise of approximately two inches at the apex A of horizontal track section 114 can be achieved by employing a radius R' of approximately 500 inches.

The configuration of the door, generally indicated by the numeral 120, depicted in FIGS. 2 and 3 of the drawings is identical to the door 20 shown and described in relation to FIG. 1. As seen, the sectional door 120 consists of a top panel 121 and an adjacent or upper middle panel 122, a lower middle panel 123, and a bottom panel 124. The top panel 121 has a top bracket 130 positioned near the top edge 131. The bracket 130 mounts a roller 132 which is offset from the door 120 a substantial distance to effect closure of the top panel when the door is in the vertical closed position depicted in the FIG. 2. A hinge bracket 140 mounting a pivot pin 141 and a roller 142 is positioned at the juncture of panels 121 and 122. A hinge bracket 150 having a pivot pin 15 1 and mounting a roller 152 is positioned at the juncture of panels 122 and 123. A hinge bracket 160 having a pivot pin 161 and mounting a roller 162 is positioned at the juncture of panels 122 and 123. A bottom roller 165 is positioned at the bottom of the bottom panel 124.

In order to keep the door 120 free from frictional resistance as it approaches and departs from the fully-closed position depicted in FIG. 2 and thus permit substantially unobstructed vertical motion, the vertical track section 111 may advantageously be placed at an angle a of approximately one degree with respect to the door 120 and the door frame F. This is accommodated in the relationship between door 120 and vertical track section 111 by positioning each of the rollers 162, 152, and 142 at a progressively greater distance or spacing from the door panels to which they are mounted. In this respect, an increased distance on the order of one-quarter inch is appropriate to accommodate an angular orientation of the vertical track section 111 at an angle a of approximately one degree. This minor variation in offset distance of the rollers 165, 162, 152, and 142 does not otherwise affect the operation of the door 120.

Figure 4:
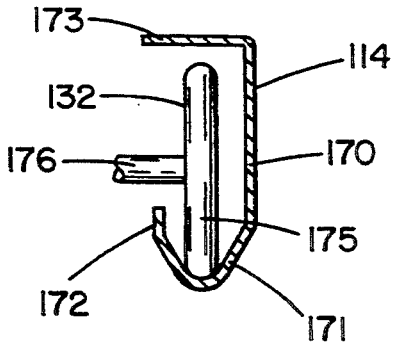
FIG. 4 is a cross-sectional view taken substantially along the line 4—4 of FIG. 3 and depicting particularly the cross-sectional configuration of the track sections and the interrelation with the panel-mounted rollers carried by the door.

An exemplary roller and track configuration is shown in FIG. 4 of the drawings. The track sections 111, 112, and 114 in cross section are normally of a generally J-shaped overall configuration, having an upstanding leg 170 and an opened U-shaped curve 171 therebelow for receiving the running surface 175 of a roller 132, which is mounted on a shaft 176. The U-shaped portion 171 terminates in an upturned, radially inwardly directed return portion 172 which serves to assist in capturing or enclosing roller 132. The top of the upstanding leg 170 terminates in a lateral leg 173 that outwardly restrains movement of a roller 132. It should be noted that only minimal clearance is provided between the U-shaped portion 171 and the lateral leg 173 of the track sections 111, 112, and 114 and running surface 175 to retain the roller 132 within the track sections, while providing precise guidance with a minimum opportunity for deviations which may produce chatter or similar objectionable noise.

With the aforedescribed configuration of horizontal track section 114, movement of the door 120 from the closed vertical position depicted in FIG. 2 to the open horizontal position depicted in FIG. 3 is without the backbreak condition discussed in conjunction with the prior art of FIG. 1. In this respect, it will be noted that the curvilinear configuration of horizontal track section 114 accommodates the displacement of roller 132 a substantially greater distance from the door than rollers 142, 152. In this respect, it is to be noted that the door panels 121 and 122 do not exceed a precisely planar position, that is where the angle $\theta$ depicted in FIG. 3 is less than 180 degrees. It is, however, preferred that the angle $\theta$ never exceed an amount slightly greater than 180 degrees, such that the inner or lower side of the door panels 121 and 122 retain a slightly downwardly concave configuration during the entire course of their travel in the horizontal track section 114.

It is to be noted that the circumstances producing a backbreak condition can arise as soon as the roller 152 reaches the horizontal track section 114 when the door 120 is moving from the closed vertical position of FIG. 2 to the open horizontal position of FIG. 3. It is significant in this respect that when the roller 152 reaches track section 114, the roller 132 will have already passed the apex A of track section 114 and be moving downwardly within the track 114 toward the lowermost point proximate end 114". It will also be appreciated that the roller 142 remains at all times seated at the bottom of U-shaped curve 171 of the horizontal track section 114 to thus maintain the weight of the door 120 distributed on the rollers, while eliminating the noise and resistance encountered when comparable roller 38 of the prior art is displaced upwardly against the top of the horizontal track section 114, as described hereinabove.

It is also significant to note that the center roller 152 of the door 120 is positioned in general proximity to the apex A of the horizontal track section 114. Therefore, substantially equivalent portions of the weight of door 120 are disposed to either side of the apex when the door is in the fully-opened position depicted in FIG. 3 of the drawings. As a result, the door 120 is in a stable, balanced condition when in the fully-open position. There is, therefore, reduced tendency for the door to overrun the open position or be overly disposed to progress overly rapidly upon the institution of closing, as may take place in the use of a linear horizontal track section 14 according to the prior art where the track 14 may be slightly upwardly or downwardly inclined.

Thus, it should be evident that the track system 110 for a sectional door disclosed herein carries out various of the objects of the present invention set forth above and otherwise constitutes an advantageous contribution to the art. As will be apparent to persons skilled in the art, modifications can be made to the preferred embodiment disclosed herein without departing from the spirit of the invention. For example, it will be appreciated that departures in the number of door panels, dimensions, configurations of the rollers, and the track cross section can be made, while incorporating the inventive features herein disclosed. The scope of the invention herein described shall be limited solely by the scope of the attached claims.

We claim:

1. An overhead door system for moving a door having at least top and downwardly adjacent second and third pivotally connected panels between a closed vertical position proximate a door frame and an open horizontal position comprising, generally vertical linear track means angularly inwardly and upwardly displaced from the bottom of the door frame, a plurality of roller means associated with the panels and retained by said track means for rolling engagement therewith during the moving of the door, first bracket means supporting first roller means at the top of the top panel, second bracket means supporting second roller means proximate the connection of the top panel and the second panel, third bracket means supporting third roller means proximate the connection of the second panel and the third panel, said first, second, and third bracket means variably spacing the panels from said vertical linear track means to engage the door frame when the door is in the closed vertical position, transition track means connected to the vertical track section and curving through an angle of approximately ninety degrees, and a substantially horizontal track means extending from said transition track means and having a downwardly concave curvilinear configuration with an apex substantially medially thereof, said horizontal track means being configured relative to the door such that said first roller means is past said apex when said third roller means reaches said horizontal track means as the door moves from the closed vertical position to the open horizontal position, whereby the top and second door panels remain downwardly concave at said second roller means during traverse of said horizontal track means.

2. An overhead door system according to claim 1, wherein said horizontal track means has a pair of spaced ends with said apex of said curvilinear configuration located substantially medially thereof.

3. An overhead door system according to claim 2, wherein said apex of said curvilinear configuration is approximately one to three inches above said ends of said horizontal track means.

4. An overhead door system according to claim 2, wherein said apex of said curvilinear configuration is substantially two inches above said ends of said horizontal track means.

5. An overhead door system according to claim 1, wherein said first roller means and said third roller means are disposed on opposite sides of said apex during the entirety of their simultaneous traverse of said horizontal track means.

6. An overhead door system according to claim 1, wherein said curvilinear configuration is an arc of a circle centered substantially directly below the middle of the door in the open horizontal position.

7. An overhead door system according to claim 6, wherein said arc of a circle has a radius of approximately 400 to 600 inches.

8. An overhead door system according to claim 1, wherein said curvilinear configuration of said horizontal track means extends substantially tangentially from the upper extremity of said transition track means.

9. An overhead door system according to claim 1, wherein said bracket means have pivot pin means for rotating the panels relative to adjacent panels during movement of the door between the closed vertical position and the open horizontal position.

10. An overhead door system according to claim 1, wherein said vertical track means is inclined upwardly away from the door frame at an angle of approximately one degree to minimize frictional resistance to movement of the door.

11. An overhead door system according to claim 6, wherein said circle has a radius of approximately 500 inches.

* * * * *